US008668788B2

(12) United States Patent
Poloni et al.

(10) Patent No.: US 8,668,788 B2
(45) Date of Patent: Mar. 11, 2014

(54) HANDLING MACHINE FOR HANDLING RAILS AND HANDLING PROCESS THEREOF

(75) Inventors: Alfredo Poloni, Fogliano Redipuglia (IT); Marco Schreiber, Brescia (IT); Daniele Andreatta, Borso Del Grappa (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 333 days.

(21) Appl. No.: 12/998,776

(22) PCT Filed: Dec. 4, 2009

(86) PCT No.: PCT/EP2009/066447

§ 371 (c)(1), (2), (4) Date: Jul. 22, 2011

(87) PCT Pub. No.: WO2010/063843

PCT Pub. Date: Jun. 10, 2010

(65) Prior Publication Data

US 2011/0272867 A1 Nov. 10, 2011

(30) Foreign Application Priority Data

Dec. 5, 2008 (IT) ..... MI2008A2163

(51) Int. Cl.
*C21D 1/00* (2006.01)

(52) U.S. Cl.
USPC ..... 148/646; 266/114

(58) Field of Classification Search
USPC ..... 266/114; 148/646, 645, 128
See application file for complete search history.

(56) References Cited

U.S. PATENT DOCUMENTS

| | | | | |
|---|---|---|---|---|
| 1,752,646 | A | 4/1930 | Lukasczyk | |
| 6,432,230 | B1 * | 8/2002 | Kock et al. | 148/646 |
| 6,689,228 | B2 * | 2/2004 | Kock et al. | 148/428 |
| 6,989,063 | B2 * | 1/2006 | Kock et al. | 148/194 |
| 2004/0113334 | A1 | 6/2004 | Kock et al. | |

FOREIGN PATENT DOCUMENTS

| | | |
|---|---|---|
| EP | 1160341 | 12/2001 |
| JP | 2004362970 | 12/2004 |

* cited by examiner

*Primary Examiner* — Scott Kastler
(74) *Attorney, Agent, or Firm* — Stetina Brunda Garred & Brucker

(57) ABSTRACT

A handling machine for handling rails, arranged in line immediately downstream of a rolling plant, which allows an optimal clamping of the rail along its longitudinal extension, thus effectively withstanding the deflection and its variations, while allowing a longitudinal movement of the rail caused by thermal shrinkage, thus avoiding damages both to the external surface of the rail and to the handlers. A process of handling the rail is also described, which optimizes moving, positioning along a roller table and maintaining the rail substantially rectilinear during the thermal treatment to which it is subjected.

13 Claims, 15 Drawing Sheets

HANDLING MACHINE FOR HANDLING RAILS AND HANDLING PROCESS THEREOF

FIELD OF THE INVENTION

The present invention relates to a rail handling machine, in particular to a machine suitable for handling at least one rail in a thermal treatment plant for rail heads, said thermal treatment plant being arranged in line and immediately downstream of a rolling plant, and also relates to a rail handling process thereof.

STATE OF THE ART

The prior art embeds various solutions of systems for thermally treating rolled rails, in particular for hardening the head by means of quenching operations.

Many of these systems are not arranged immediately at the rolling mill outlet. This implies the need to stock the rolled rails and then heat them before proceeding with the thermal quenching treatment, with high energy consumption and low efficiency.

In other solutions, instead, these systems are arranged downstream of the rolling mill: the rolled rail is unloaded onto a roller table fixed to the ground; it is then picked up by handlers, comprising complex leverages, which manage the movement of the rail during the thermal treatment that the rail undergoes; and it is finally ejected onto the cooling plate or bed by means of appropriate ejection mechanisms.

The rails, either heated or coming directly from the rolling mill, are subjected to rapid cooling of the head either by using spraying nozzles which inject a cooling fluid (water, air or water mixed with air) onto the rail head or by immersing the head into a tank containing the cooling fluid.

In particular, if the immersion tank is used, cooling is more uniform lengthwise, but in all cases the temperature difference between the base of the hot rail and the cooled head results in the rail deflection or bending.

In actual fact, the rail is already bent at the rolling plant outlet. In particular, due to the temperature difference between the flange (or sole) and the head, the rail bends forming a concavity on the colder side.

The flange is colder than the head before carrying out the thermal treatment; therefore, the flange has a concave longitudinal profile.

During the thermal treatment, the head cools down faster than the flange, and at the end of the treatment the head is colder than the flange and has a concave longitudinal profile.

After a few minutes, the flange is colder than the rail head again; therefore the concave profile will be present on flange side again.

These variations of the longitudinal profile of the rail, more accentuated at the ends, cause the exertion of high vertical forces on the rail handler clamps; these forces could cause the clamps themselves to open with the consequent rail drop.

The clamps of the prior art have the disadvantage of being unsuitable for withstanding and containing said deflection and its variations during the thermal treatment.

In order to obviate this drawback, handlers with hydraulic cylinders for actuating the rail clamps such as to produce very high clamping forces have been designed. On one hand, these forces ensure a good clamping of the rail while it is being moved and transferred close to the cooling tank, but on the other hand they hinder the longitudinal movement of the rail caused by thermal shrinkage that the rail itself undergoes when it is cooled down. It is indeed known that a rolled rail, e.g. 100 meters long, becomes about even 100-120 cm shorter when it cools down. This shortening may cause damages both to the rail surface and to the handlers themselves due to the high clamping forces of the clamps on the rail.

The need to provide a handling machine for handling rails and a handling process thereof capable of overcoming the aforesaid drawbacks is therefore felt.

SUMMARY OF THE INVENTION

It is the main object of the present invention to provide a handling machine for handling rails arranged in line and immediately downstream of a rolling plant, which allows an optimal clamping of the rail along its longitudinal extension, thus effectively withstanding the deflection and its variations while allowing a longitudinal movement of the rail caused by thermal shrinkage, thus avoiding damages both to the external surface of the rail and to the handlers.

Another object of the invention is to provide a thermal treatment plant for rails comprising the aforesaid handling machine.

A further object of the invention is to implement a process of handling the rail which optimizes handling, positioning along a roller table and maintaining the rail substantially rectilinear during the thermal treatment to which it is subjected.

The present invention thus suggests to achieve the above-discussed objects by providing a handling machine for handling a rail provided with a head and flange, which, comprises:

- a plurality of tilting means for tilting the rail from a first position inclined on a side thereof to a second position with the rail head turned upwards;
- a plurality of handlers provided with clamping means adapted to clamp the rail at the flange, and adapted to move the rail from said second position with the rail head turned upwards to a third position with the rail head turned downwards;

wherein said clamping means are provided with two jaws, pivotable around respective pivoting pins and configured so that the rail is clamped by contacting portion of internal surface of the jaws only with the sides of the flange of the rail.

A second aspect of the present invention includes a thermal treatment plant for rails for subjecting a head of said rails to an in-line thermal treatment, the rails exiting from a rolling plant defining a rolling axis, the thermal treatment plant comprising:

- a first longitudinal roller table, placed parallel icy the roiling axis;
- a first longitudinal cooling tank, placed adjacent and parallel to said first roller table; and a handling machine, wherein
- first tilting means are arranged along the first roller table for tilting the mils from a first position inclined on one side thereof on said first roller table to a second position with the head of the first rail turned upwards on the same first roller table;
- and a first series of handlers, provided with clamping means adapted to clamp a first rail at the flange, which is suitable for moving said first rail from said second position on the first roller table to a third position above the first cooling tank with the head turned downwards.

A further aspect of the present invention includes a process for handling a rail by means of the aforesaid handling machine comprising the following steps in accordance with claim 13:

tilting the rail, by means of a plurality of tilting means, from a first position inclined on a side to a second position with the rail head turned upwards;

clamping the rail, by means of clamping means of a plurality of handlers, by contacting portions of internal surface of the jaws only with the sides of the flange of the rail; and rotating the handlers to move the rail from said second position with the head turned upwards to a third position with the head turned downwards.

The handling machine and process for handling rails of the present invention also advantageously has the following advantages:

a better clamping of the bent rail, while exerting relatively low clamping forces during the thermal quenching treatment in the tank, due to the fact that the application point of the forces generated by clamping the clamps on the bent rail flange is substantially aligned with the rotation fulcrums of the clamps themselves;

the possibility of controlling the hydraulic cylinders for actuating the clamps of the handlers so as to pass from a high clamping force when handling the rail, from the roller table to the immersion position of the rail in the cooling tank, to resist the weight force thereof and the centrifugal force which is produced during the rotation of the handlers; and to a sufficiently low clamping force during the immersion to allow the rail shortening due to thermal shrinkage.

The handling, machine and process are inserted in a thermal treatment plant layout which includes using three cooling tanks with the following advantages:

it allows to obtain high production rates in terms of rails treated per unit of time;

it is flexible by virtue of the fact that it allows to unload rolled rails without thermally treating them and to change the production campaign to manufacture beams or profiles; and it is modular, i.e. it allows to add other cooling tanks in order to further increase the the hourly production rate, if desired.

BRIEF DESCRIPTION OF THE DRAWING

Further features and advantages of the invention will be more apparent in the light of the detailed description of a preferred, but not exclusive, embodiments of a handling machine for handling rails, shown by way of non-limitative example with the aid of the accompanying drawings, in which.

DETAILED DESCRIPTION OF PREFERRED EMBODIMENTS OF THE INVENTION

Figure 2:
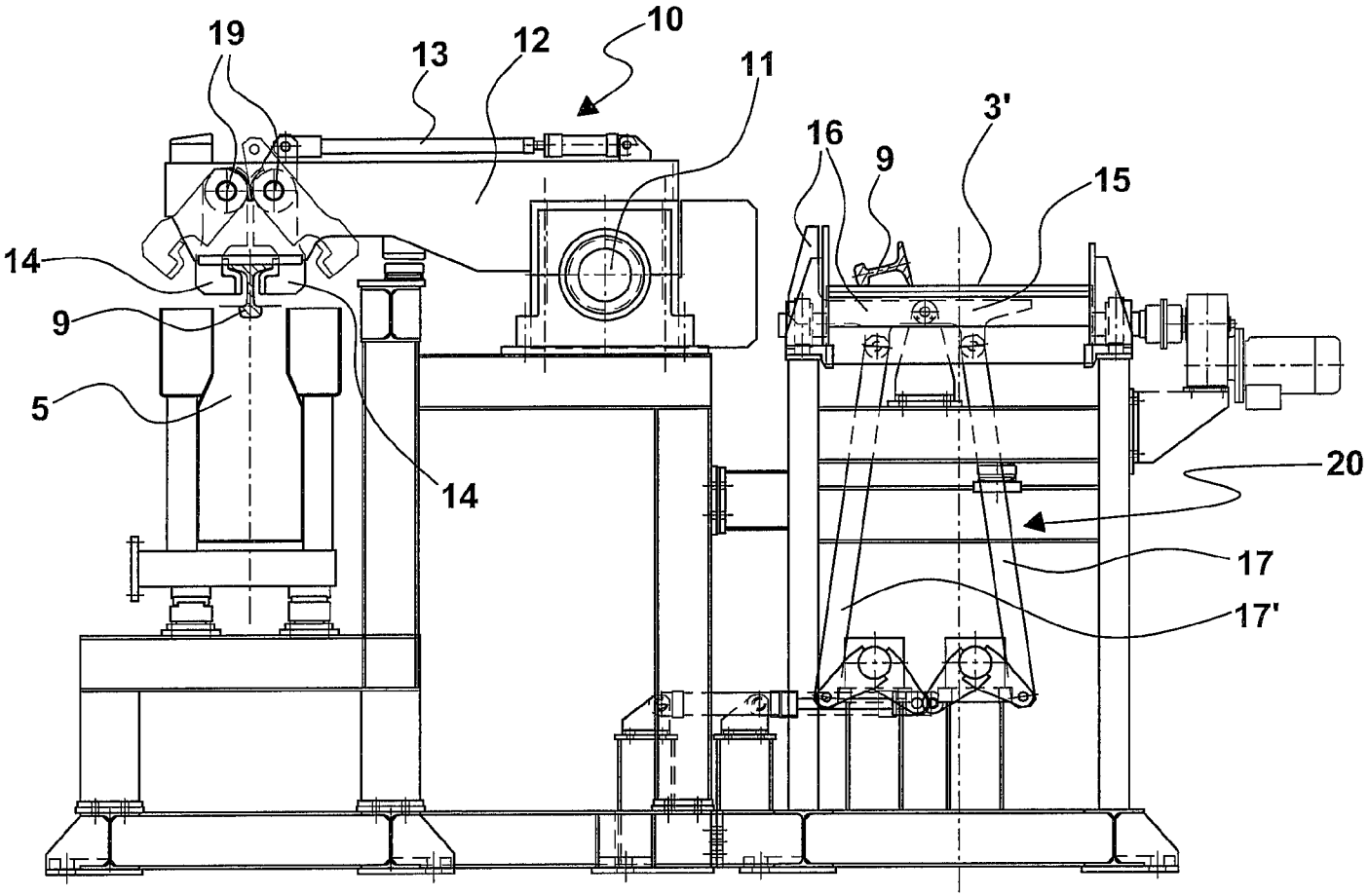
FIG. 2 is a side view of a handling machine for handling rails according to the invention.
Figure 3:
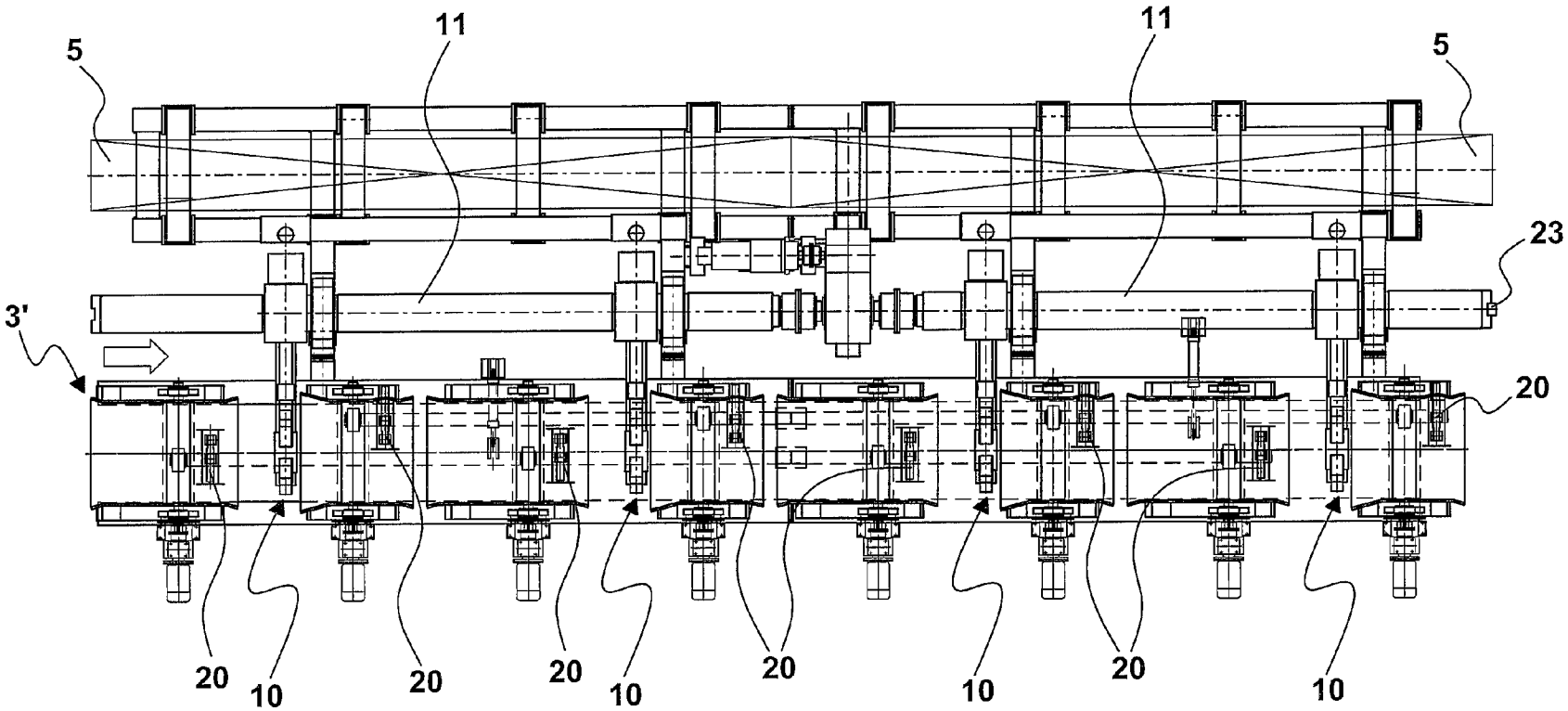
FIG. 3 is a top view of a first module of the handling machine according to the invention.

FIGS. 2 and 3 show a preferred embodiment of a handling machine for handling rails according to the present invention. The rails are provided with a head, a core and a flange or sole. The flange, in turn, comprises a flat base, the sides and back having surfaces which are inclined with respect to the base plane. The sides and the inclined surfaces are connected by a coupling section.

Figure 2A:
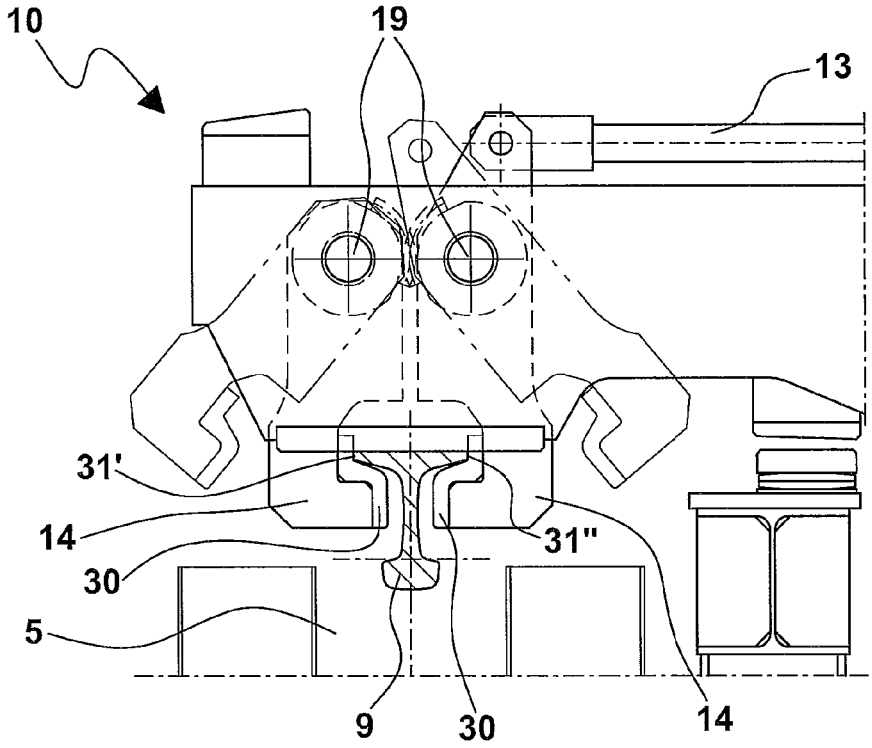
FIG. 2*a* is an enlargement of a first part of the side view in FIG. 2, with a handler arranged in the immersion position of the rail head into the tank.
Figure 2B:
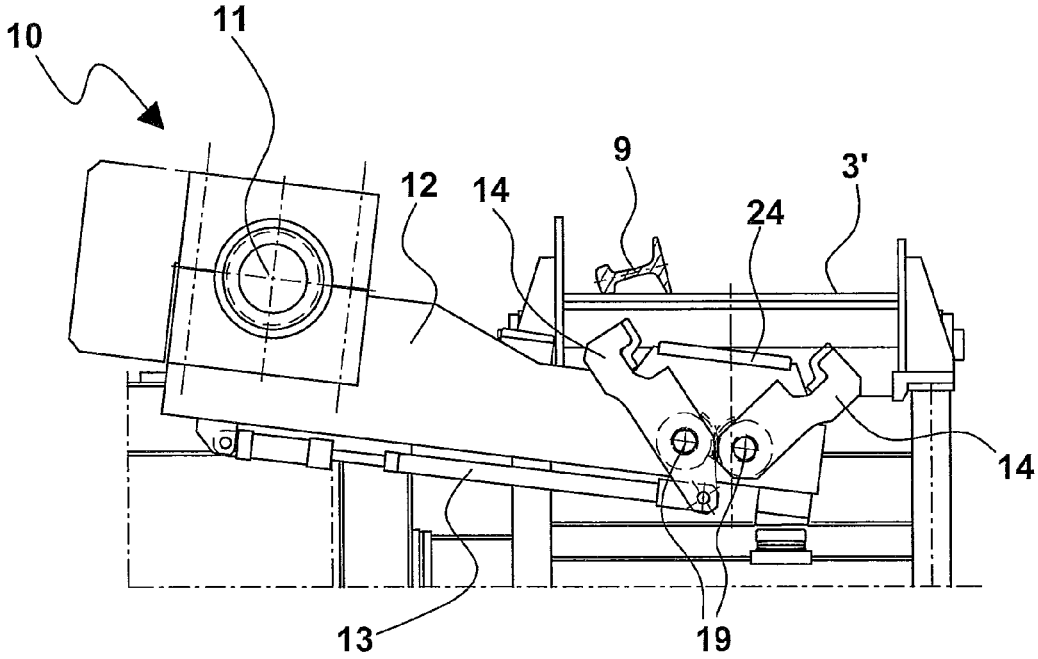
FIG. 2*b* is an enlargement of a second part of the side view in FIG. 2, with a handler in rest position.
Figure 2C:
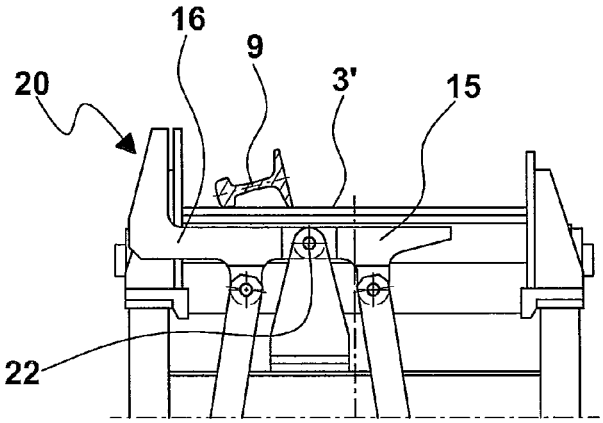
FIGS. 2*c*, 2*d* and 2*e* show the steps of tilting a rail on a rolled table according to the process of the invention.
Figure 2D:
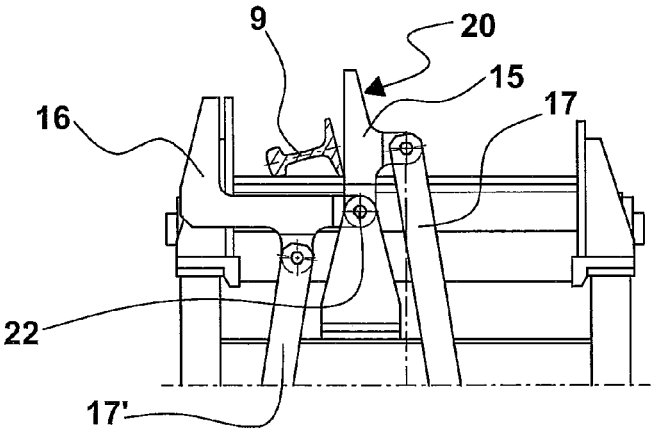
Figure 2E:
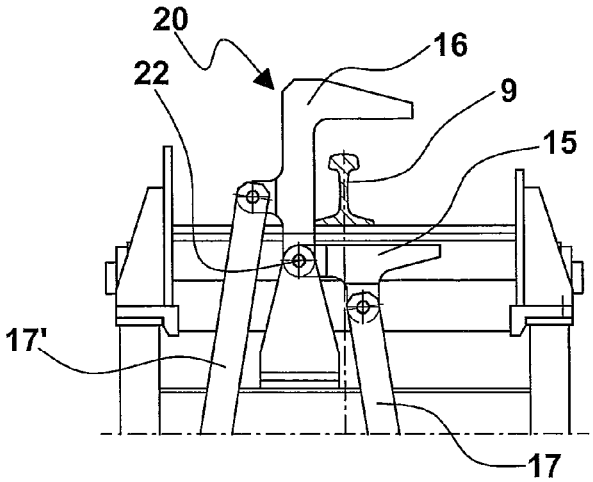

In a first variant, such a machine comprises:

a longitudinal rolled table 3', arranged either parallel to the rolling axis or directly along the rolling axis to receive the rail 9 exiting from the last rolling mill stand;

a longitudinal cooling tank 5, arranged adjacent and parallel to said roller table 3', for thermally treating the rail 9 by immersion in a cooling fluid contained in said tank;

a plurality of tilting means 20, arranged along the roller table 3', for tilting the rail 9 from an inclined position on one side with the head facing the cooling tank 5 (FIG. 2*c*), position with which the rail reaches the roller table, to a position with the head facing upwards, with the flange completely resting on the roller table 3'(FIG. 2*e*);

a plurality of handlers 10 provided with clamps, adapted to clamp the rail 9 at the flange and rotate it from the position on the roller table with the head facing upwards (FIG. 2*e*) to a position with the head facing downwards and immersed in the cooling tank 5.

The cooling tank 5 has a longitudinal extension such as to allow the entire rail to be immersed therein. Once the thermal treatment of the head has been completed, the rails are unloaded from the roller table onto a cooling plate or bed.

The tilting means 20, arranged along the roller table 3' with a step of 1,5 meters, for example, each comprise leverages actuated by two plates or "hands" 15, 16 for tilting the rail 9. Each pair of plates 15, 16 of the tilting means is hinged onto a pin 22 fixed underneath the plane defined by the roller table. The plates 16 advantageously have a substantially L-shaped section along a plane perpendicular and transversal to said roller table plane.

The handlers 10, arranged along the roller table 3' with a step of 3 meters, for example, each comprise an arm 12 integrally fixed at one end thereof onto a transmission shaft 11, provided in an intermediate position between the tank 5 and the roller table 3'.

Each arm 12 is provided at the other end with a clamp, the jaws 14 of which are hinged to fulcrums or pivoting pins 19. A hydraulic cylinder or other appropriate actuation means is also provided on each arm to actuate the jaws 14.

The clamps are configured so that the jaws 14 are provided with an internal surface usually provided on a wear element 30, commonly named "gib", having a profile substantially mating with that of the rail to about half core and suitable for abutting on the sides of the sole or flange of the rail, leaving instead a predetermined clearance on the back or inclined surface of the sole. Indeed, the inclination angle of the back of the sole, with respect to the flange base plane, is smaller than the inclination angle of the mating internal surface of the jaw 14 in the clamping position.

With the rail 9 clamped in the jaws 14 in a clamping position (FIG. 2*a*), the deflection or bending of the rail itself along its longitudinal extension generates, at some points, the contact of a portion of the coupling section with a corresponding portion of the internal surface of the jaws; forces parallel to the symmetry plane of the rail having an intensity of about one order of magnitude higher than the closing force exerted by the jaws themselves are exerted on these contact surfaces.

The resultant of said parallel forces advantageously has a direction either passing through or not very distant from the axis of the respective pivoting pin 19. Therefore, the arm of the resultants of the forces parallel to the symmetry plane of the rail, generated by the bending of the rail when the bent rail is clamped by the jaws, with respect to the pivoting pins 19 is null or however small, e.g. up to a maximum of 30 mm and preferably equal to 5 mm, and therefore the momentum generated by said forces parallel to the symmetry plane of the rail with respect to the pivoting pins 19 of the closed jaws is either null or negligible.

FIG. 3 is a top view of a first module of the handling machine of the invention. The other modules are arranged side-by-side in sequence to reach the desired longitudinal extension of the handling machine.

A control system is provided for each module, preferably a synchronous motor. The transmission shafts 11 of the various modules are controlled by the respective motors. If transmission problems occur in any module of the plant, the shafts 11 are advantageously provided at one end with a connection element 23 adapted to mesh with a corresponding recess provided at the proximal end of the subsequent shaft 11.

Figure 6:
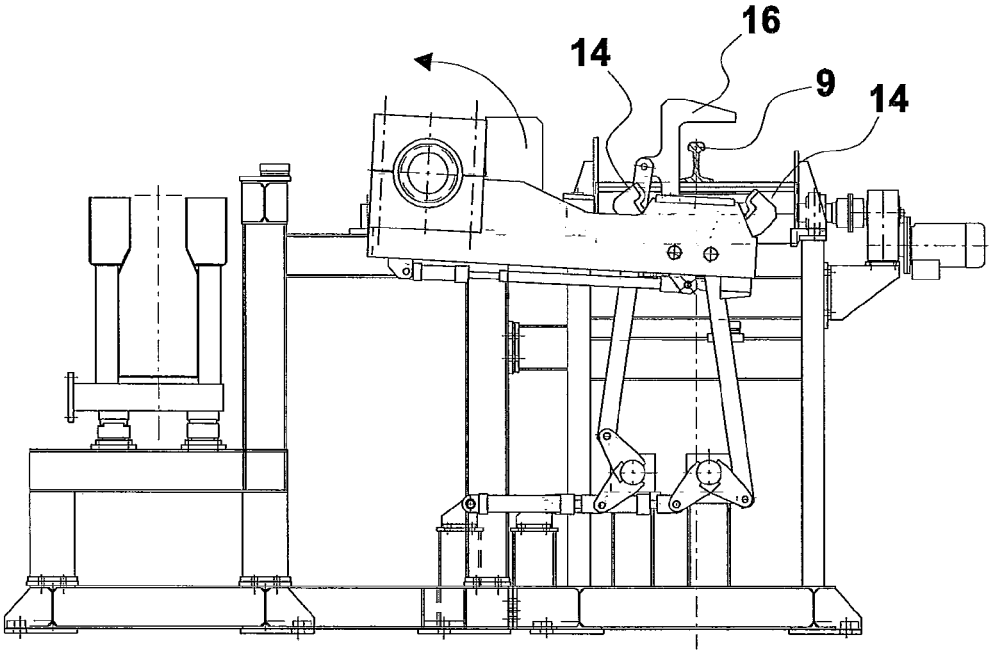
FIGS. 6 to 20 show some steps of the process of handling rails according to the invention.
Figure 7:
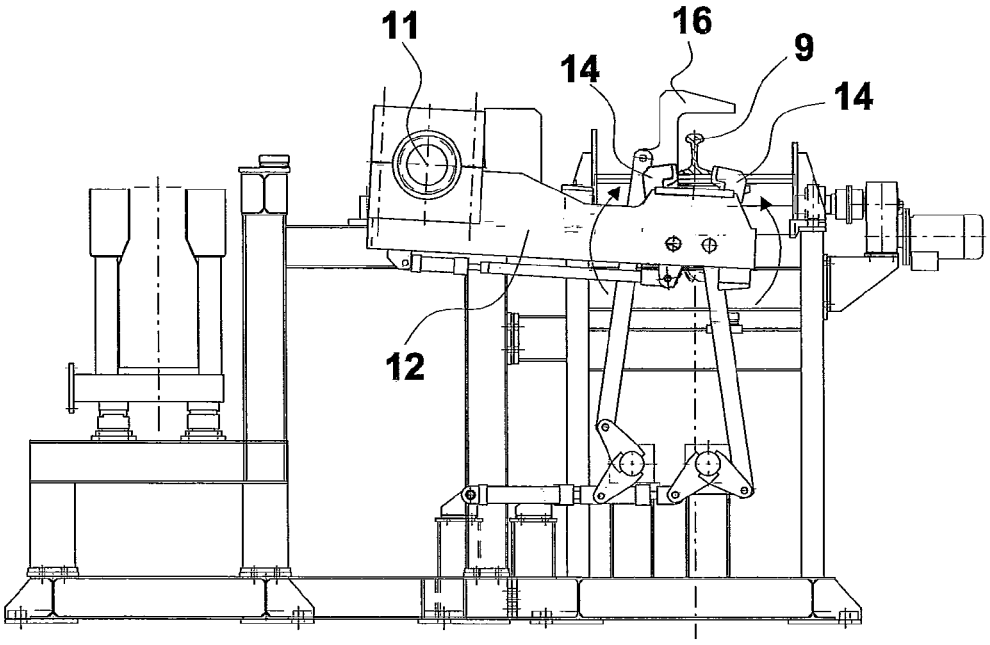
Figure 8:
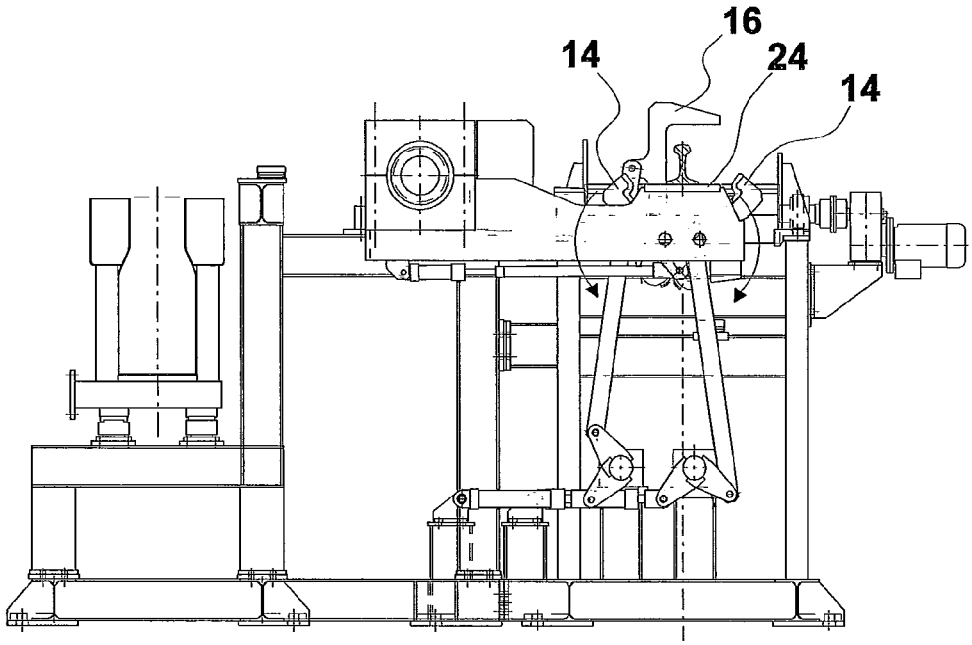
Figure 9:
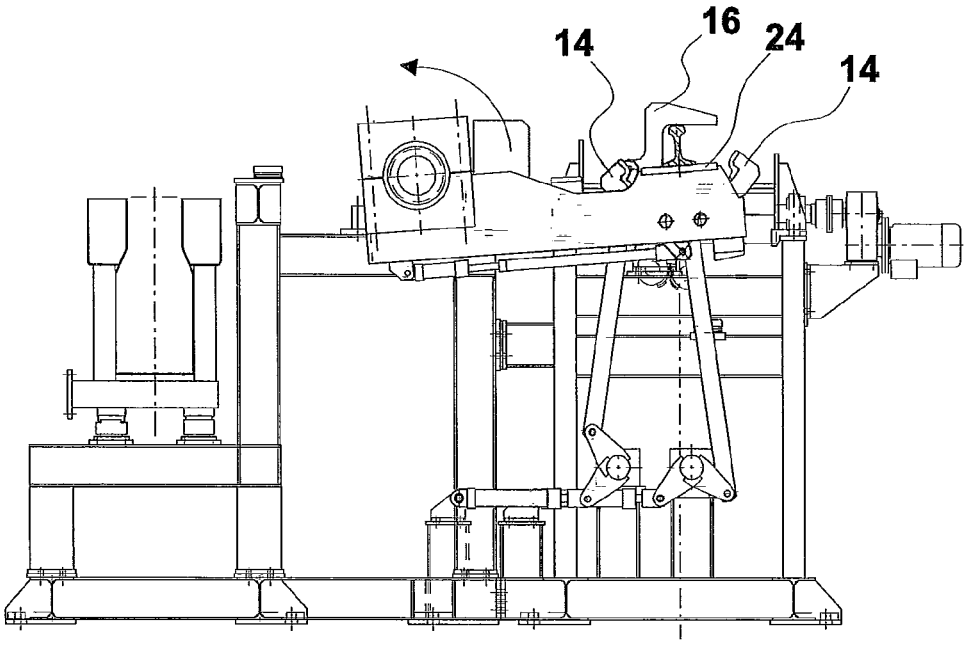
Figure 10:
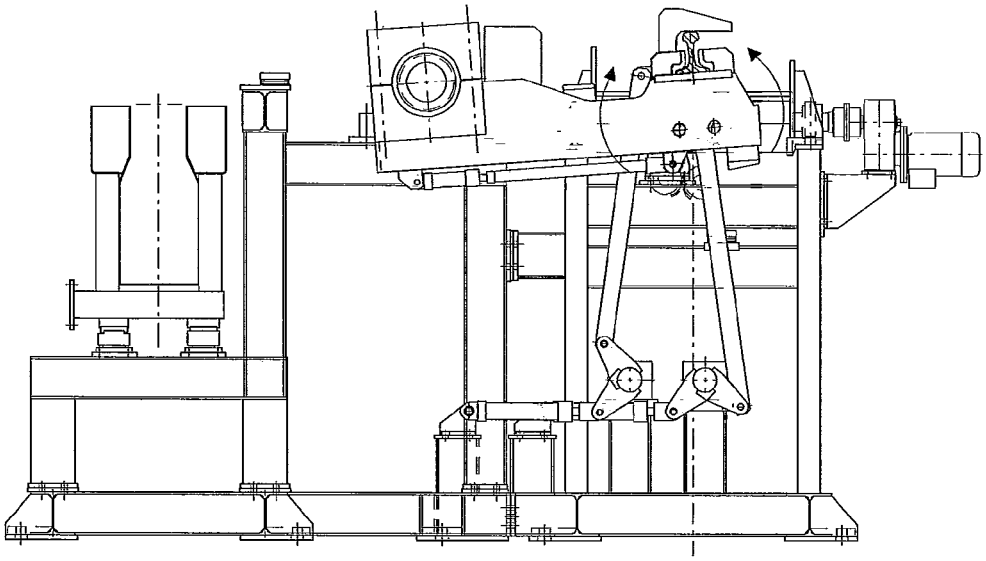
Figure 11:
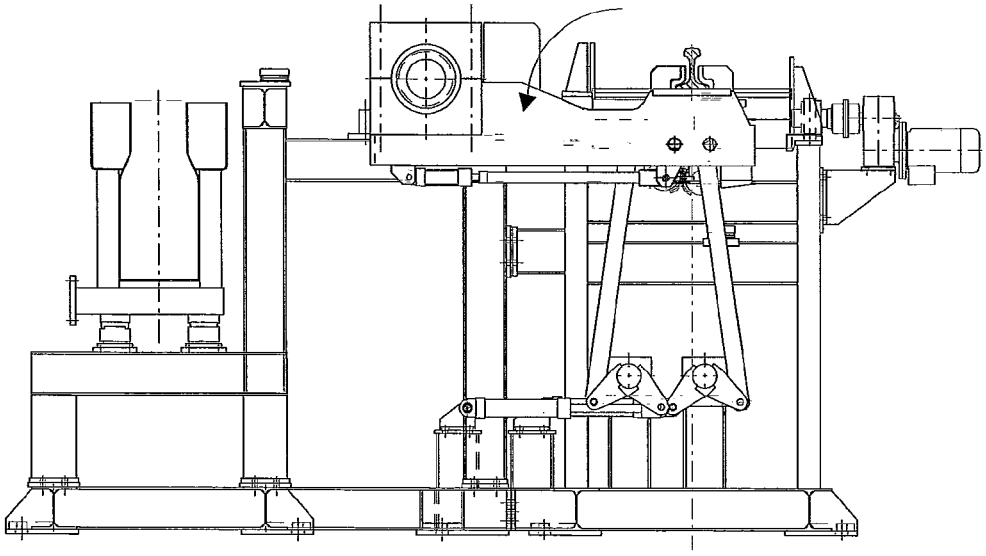
Figure 12:
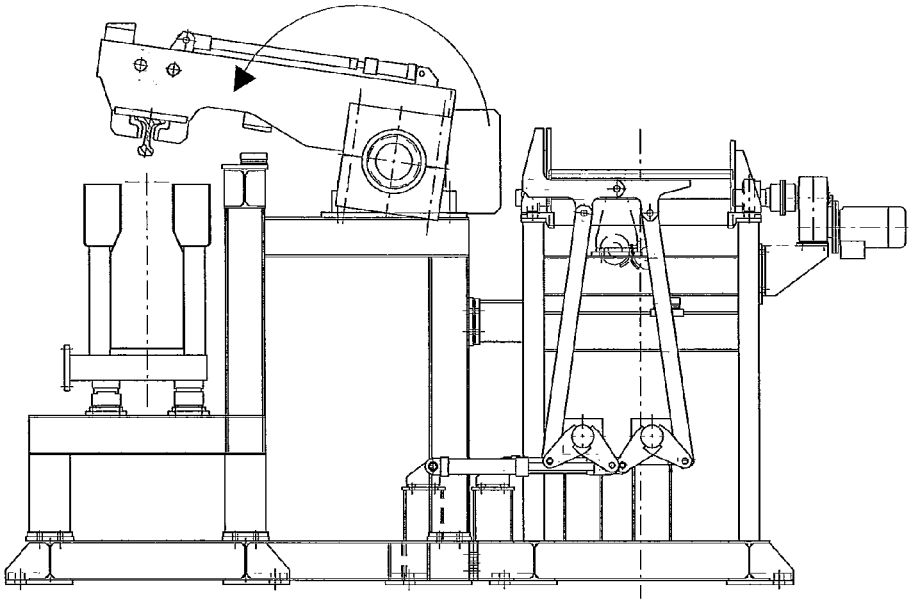
Figure 13:
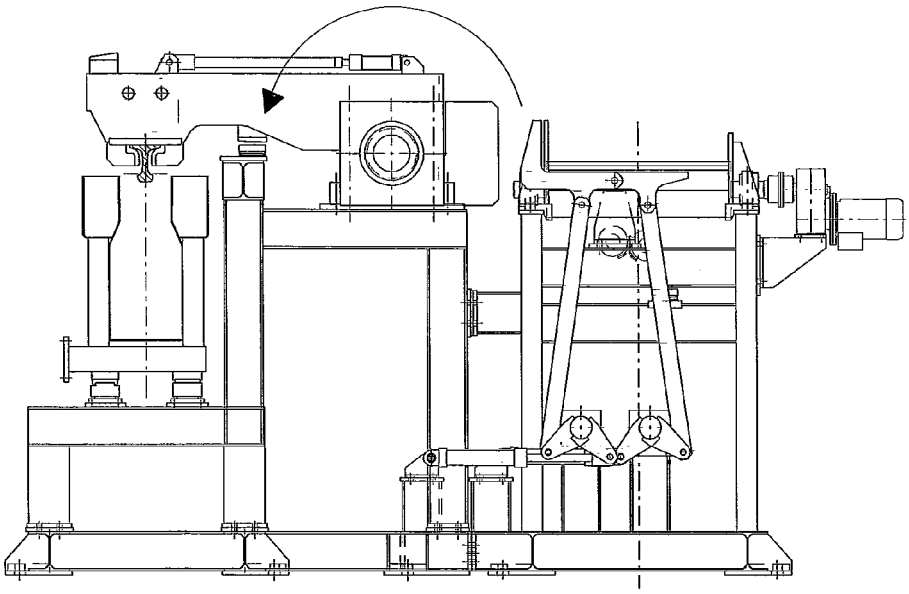
Figure 14:
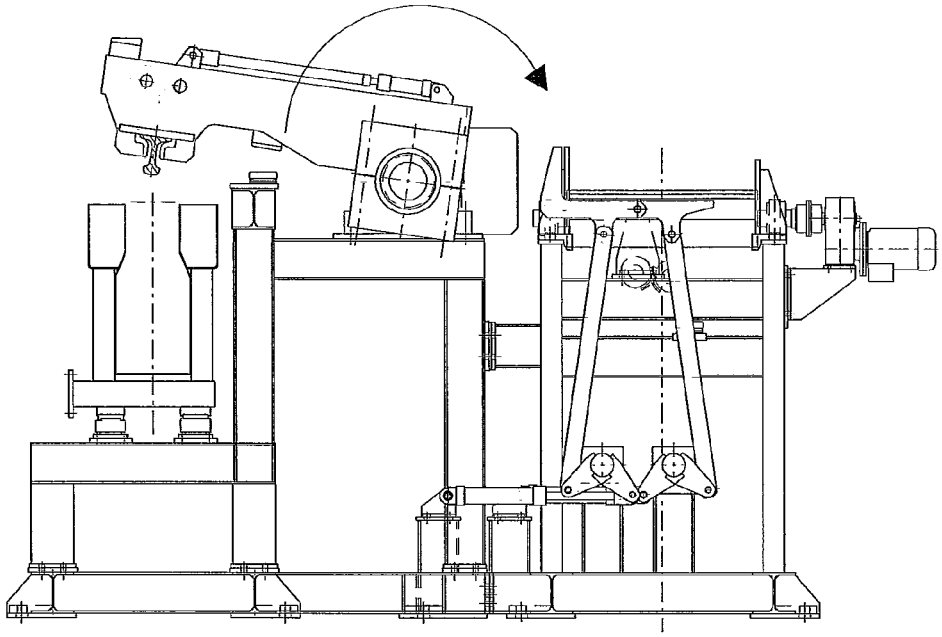
Figure 15:
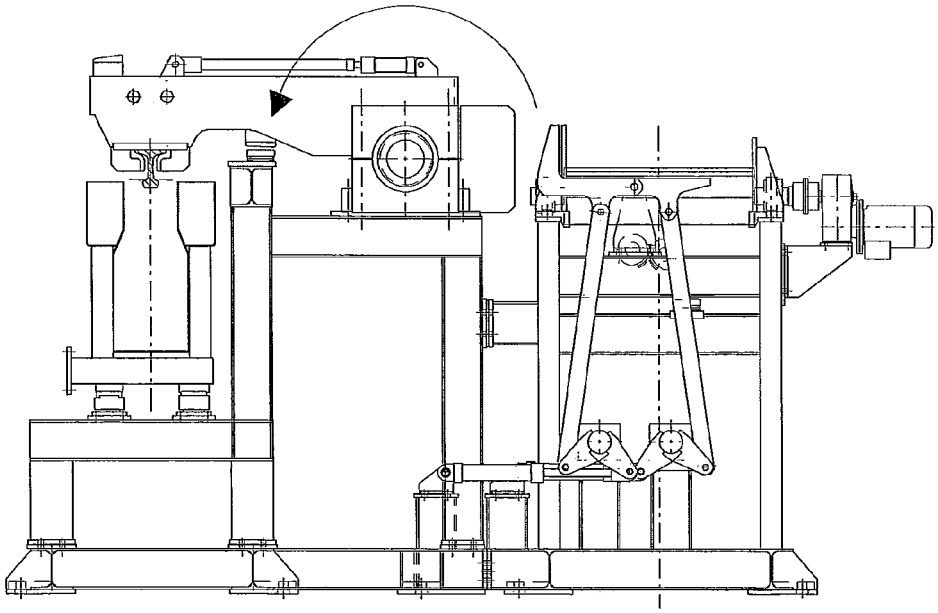
Figure 16:
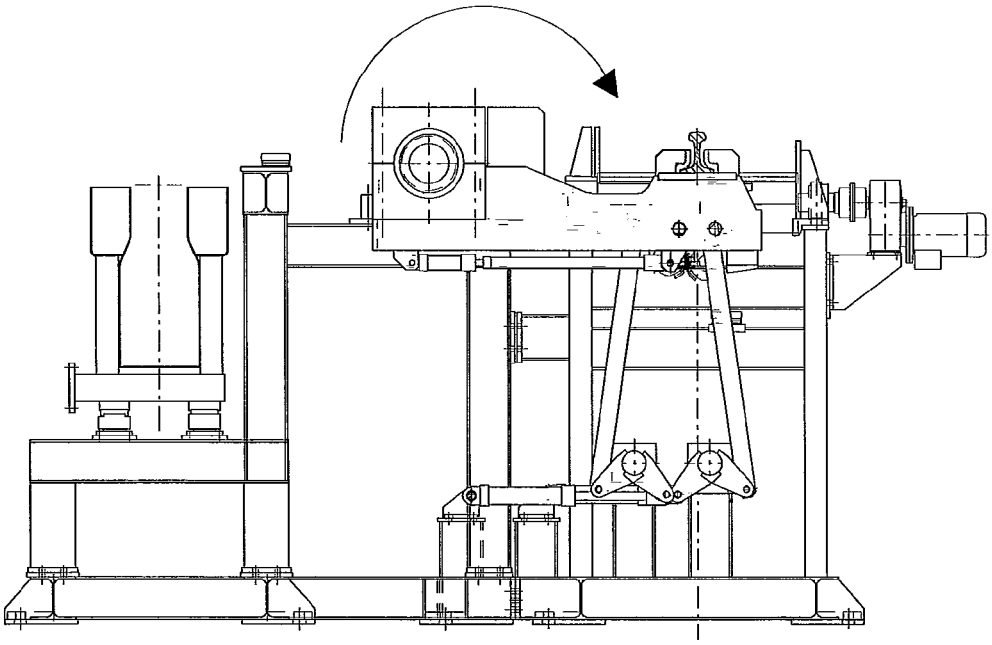
Figure 17:
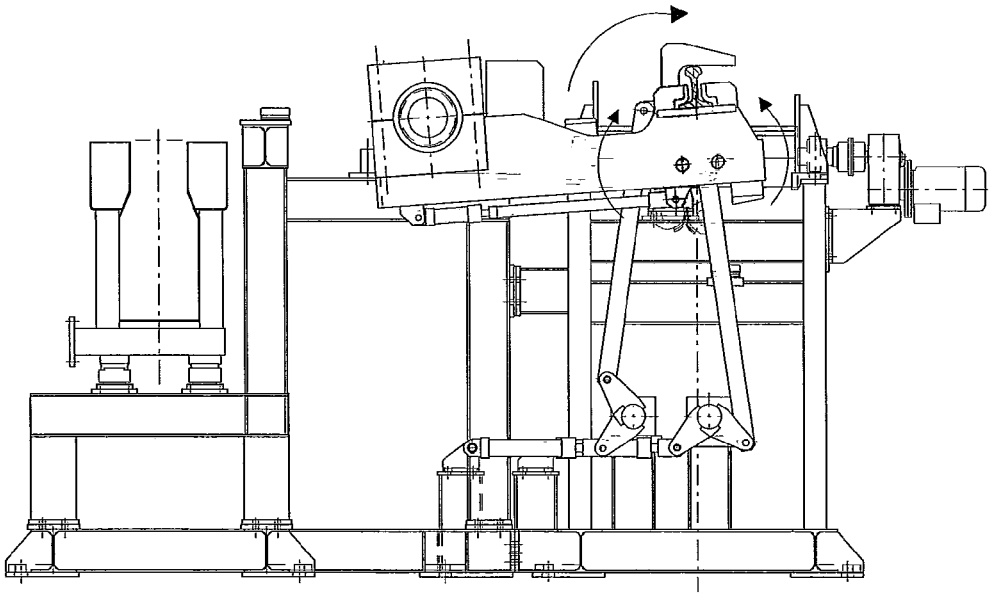
Figure 18:
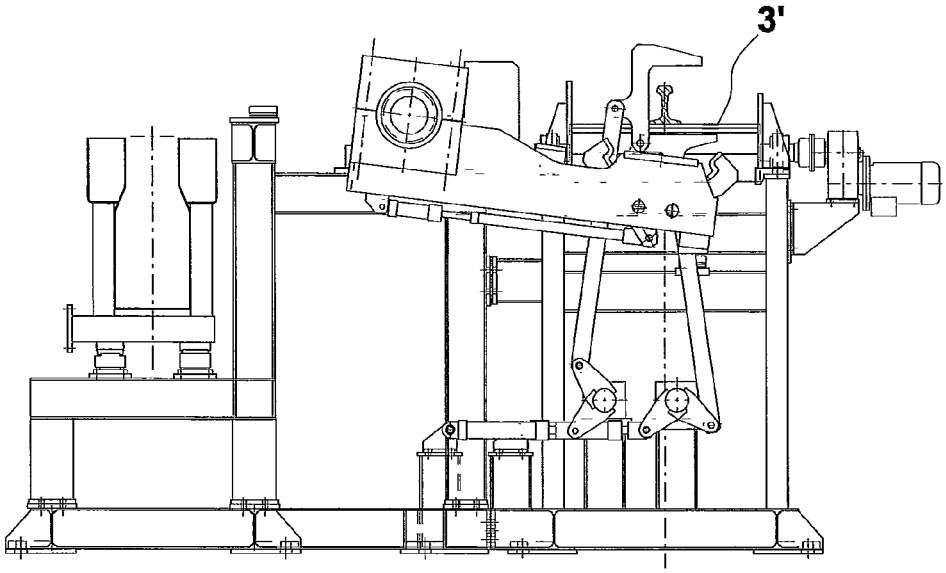
Figure 19:
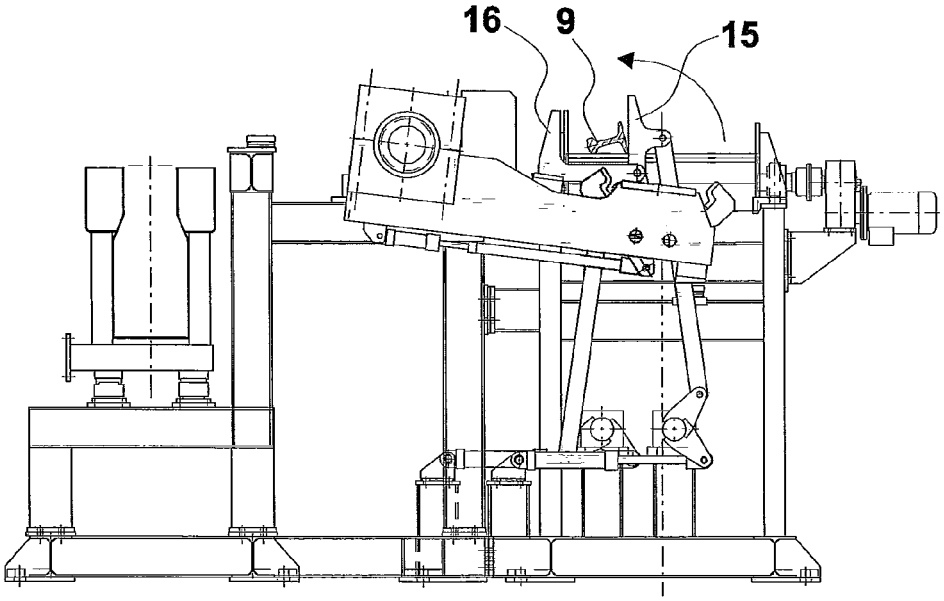
Figure 20:
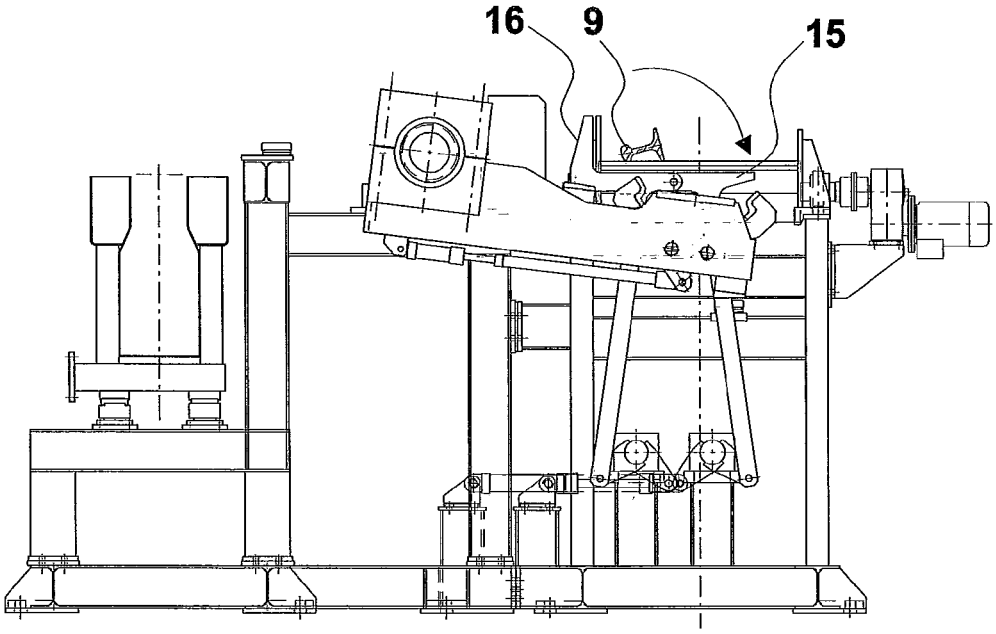

The process of handling the rails implemented using the aforesaid first embodiment of the handling machine comprises the following steps:

1) unloading a rail 9 onto the roller table 3' in an inclined position on one side and arranged laterally with respect to the longitudinal midline plane of the roller table 3' itself; during this step of receiving the rail, the plates 15, 16 of the tilting means 20 are aligned so as to define a L-shaped cross section as a whole having the longer arm substantially parallel to the plane defined by the roller table 3' (FIGS. 2, 2*c*);
2) actuating the plates 15 so that they rotate by 90° in a first rotation direction about the pin 22 and the plates 15 and 16 define a substantially U-shaped cross section as a whole, within which the rail 9 is in an inclined position (FIG. 2*d*);
3) actuating the plates 15 and 16 so that they integrally rotate by 90° in a second rotation direction opposite to the first about the pin 22, and that the rail 9 is tilted in a position with the head facing upwards and with the sole completely resting onto the roller table 3'; the plates 15 and 16 define a substantially C-shaped cross section as a whole (FIG. 2*e*);
4) possibly centering the rail 9 on the roller table 3' by means of the clamps of handlers 10 to avoid sliding on the rail, in particular on the head and tail ends, during the step of clamping the clamps (FIGS. 6 to 8);
5) straightening the rail by the cooperation of handlers 10 and plates 16 of the tilting means; starting from the rest position, the handlers 10 rotate with the open jaws so as to raise the rail 9, by means of a supporting surface 24, up to reach a contact position between the rail head and the plates 16 of the tilting means in the raised position (FIG. 9);
6) clamping the rail 9, in the aforesaid contact position between the rail head and the plates 16, by completely closing the jaws 14 which abut on the sides of the flange leaving instead a predetermined clearance between jaws and upper surface of the flange (FIG. 10);
7) actuating the plates 16 so that they rotate by 90° in the first rotation direction about the pin 22 (FIG. 11) and are released from the head of the rail; the plates 15 and 16 are thus aligned so as to define a substantially L-shaped cross section as a whole, having the longer arm substantially parallel to the plane defined by the roller table 3', as shown for example in FIG. 2*c;*
8) rotating the handlers 10 in the first rotation direction, by about 170°, to place the head of the rail 9 facing downwards at a predetermined distance from the cooling tank 5 (FIG. 12); the rail 9 is kept in this position until the head reaches a predetermined surface temperature of at least 720° C. by means of in-air cooling;
9) further rotating the handlers 10 in the first rotation direction to an immersion position of the rail head into the tank 5 (FIG. 13); this cooling by means of cooling fluid contained in the tank lasts until a surface temperature of the rail head from 50 to 150° C. higher than temperature Ar3 is reached so as to prevent the phase transformation from austenite to pearlite;
10) rotating the handlers 10 in the second rotation direction opposite to the first to place the head of the rail 9 facing downwards at said predetermined distance from the cooling tank 5 (FIG. 14); the rail 9 is kept in this position until, by in-air cooling, the surface temperature of the head is equalized to the temperature of a surface layer of the rail head, said layer having a depth from 15 to 25 mm from the head surface;
11) rotating the handlers 10 in the first rotation direction to the immersion position of the rail head into the tank 5 (FIG. 15); this further cooling by means of cooling fluid lasts until a surface temperature of the rail head lower than 500° C. is reached, whereby the phase transformation from austenite to pearlite occurs;
12) rotating the handlers 10 in the second rotation direction by about 170°, to place the head of the rail 9 facing upwards (FIG. 16) at the position in which the clamping has been performed;
13) actuating the plates 16 so that they rotate by 90° in the second rotation direction about the pin 22 to engage on the head of the rail (FIG. 17); the plates 15 and 16 thus define a substantially C-shaped cross section as a whole;
14) opening the jaws 14 and further rotating the handlers 10 in the second rotation direction to rest the sole of the rail on the roller table 3' and reach the aforesaid rest position (FIG. 18);
15) actuating the plates 15 and 16 so that they integrally rotate by 90° in the first rotation direction about the pin 22 and that the rail 9 is tilted in the inclined position on a side with the head facing towards the cooling tank 5 and laterally arranged with respect to the longitudinal midline plane of the roller table 3 itself; the plates 15 and 16 thus define a substantially U-shaped cross section as a whole (FIG. 19);
16) actuating the plates 15 so that they rotate by 90° in the second rotation direction about the pin 22 and that the plates 15 and 16 define a substantially L-shaped cross section as a whole, having the longer arm substantially parallel to plane defined by the roller table 3' (FIG. 20).

At this point, the thermally treated rail is ready to be fed on the roller table 3' and then be unloaded on a cooling plate.

Once the thermal quenching treatment of the rail has been finished, comprising four steps of cooling—respectively in air, in liquid, and in air and liquid—a surface layer of the rail head, from 15 to 25 mm deep starting from the external surface of the head, is advantageously obtained, said surface layer having a uniform, fine grain pearlite structure with a grain size preferably comprised between the values 9 and 4 according to Russian standard GOST 8233-56.

The rail 9 is preferably unloaded onto the roller table 3' in an inclined position on a side with the head facing towards the cooling tank 5 and in a side part of the roller table proximal to the tank 5 (case shown in the figures); alternatively, it may be unloaded onto the roller table 3' in an inclined position on a side with the sole facing the cooling tank 5 and in the side part of the roller table distal from the tank 5 (case not shown).

The possible centering of the rail 9 on the roller table 3' (step 4) is carried out by:

- slightly rotating the handlers 10 from the rest position with the jaws open (FIG. 2*b*) to reach a substantially horizontal position (FIG. 6);
- partially closing the jaws 14 of the clamps to contact both sides of the flange and centre the rail 9 on the roller table 3' without clamping it (FIG. 7);
- re-opening the jaws 14.

Measuring the surface temperature of the rail head may be provided during step 8), by means of pyrometers arranged on the supporting structure of the handlers 10.

Before performing steps 7) and 13), i.e. before actuating the plates 16 so that they either engage or release the head of the rail, respectively, a lowering of the handlers 10 may be provided to avoid sliding on the surface of the rail head.

Figure 1:
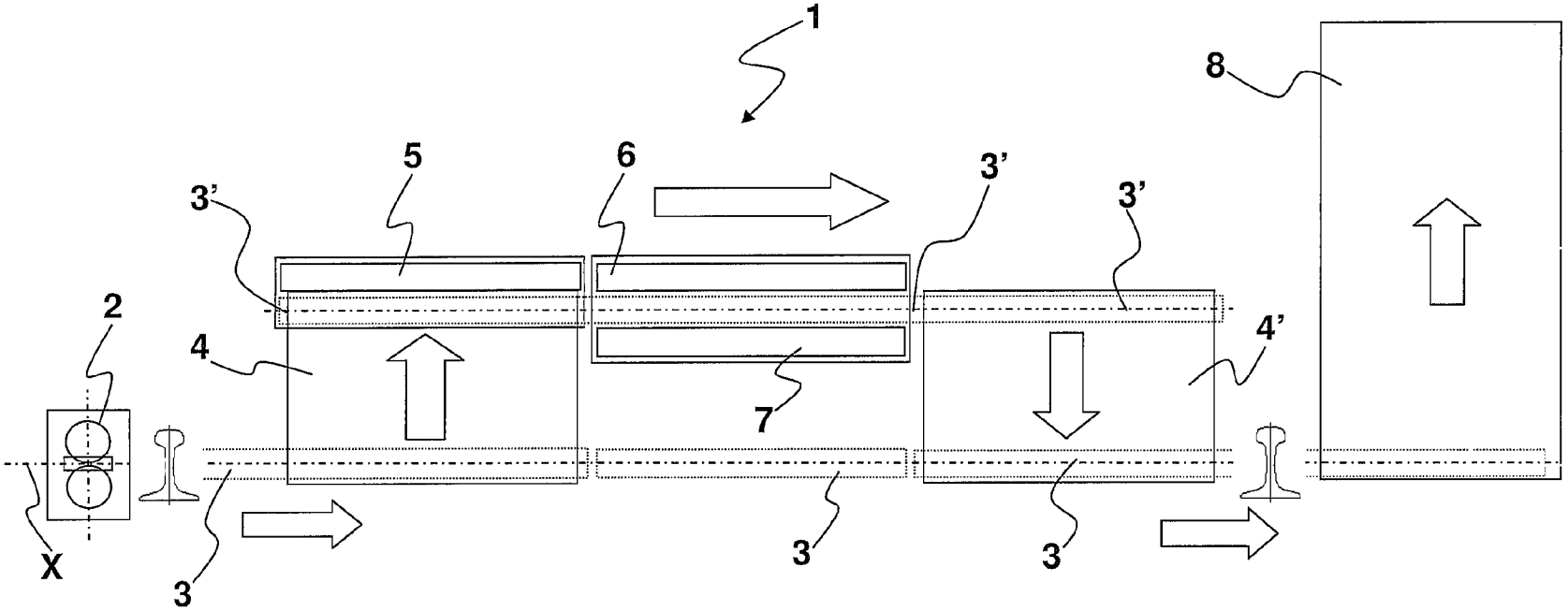
FIG. 1 is a layout of a plant for thermally treating the rail head according to the invention.

FIG. 1 shows a layout of a part of the rail production plant comprising a second preferred embodiment of the handling machine object of the present invention. This example layout comprises:

- a billet rolling plant suitable for producing rails, or beams and profiles, defining a rolling axis X (only the last rolling mill stand 2 is shown in FIG. 1);
- the thermal treatment plant 1 for subjecting the rails to the thermal treatment of head comprising said handling machine;
- a cooling plate or bed 8, onto which the treated rails 9 are unloaded.

A possible straightening machine may be provided downstream of the cooling plate 8, which is used to obtain the rectilinearity tolerances required by the market, as well as an evacuation roller table towards the storage area.

The thermal treatment plant 1 comprises:

- the first longitudinal roller table 3', placed parallel at a predetermined distance from the rolling axis X;
- a second longitudinal roller table 3, arranged along the rolling axis X, for receiving and feeding the rails exiting from the last rolling mill stand;
- a first transfer trolley 4 to transfer the rails 9 received from the second roller table 3 to the first roller table 3';
- a first longitudinal cooling tank 5, arranged adjacent and parallel to a first initial portion of the roller table 3', for thermally treating the head of a first rail;
- a second longitudinal cooling tank 6, arranged adjacent and parallel to a second portion of the first roller table 3', said second portion being subsequent to the first portion, for thermally treating the head of a second rail;
- a third longitudinal cooling tank 7, arranged adjacent and parallel to said second portion on the opposite side to the one on which the second tank 6 is arranged, for thermally treating the head of a third rail;
- a second transfer trolley 4', for transferring the thermally treated rails 9 from the first roller table 3' to the second roller table 3 which unloads them onto the cooling plate 8.

The cooling tanks 5, 6, 7 have a longitudinal extension such as to allow to immerse the whole rail therein.

Possible croppers may also be provided between the second transfer trolley 4' and the cooling plate 8.

The second roller table 3 may be employed to directly unload onto the plate 8 either the rails which do not need to be treated or the beams or profiles manufactured during specific production campaigns and needing no treatment.

Figure 5:
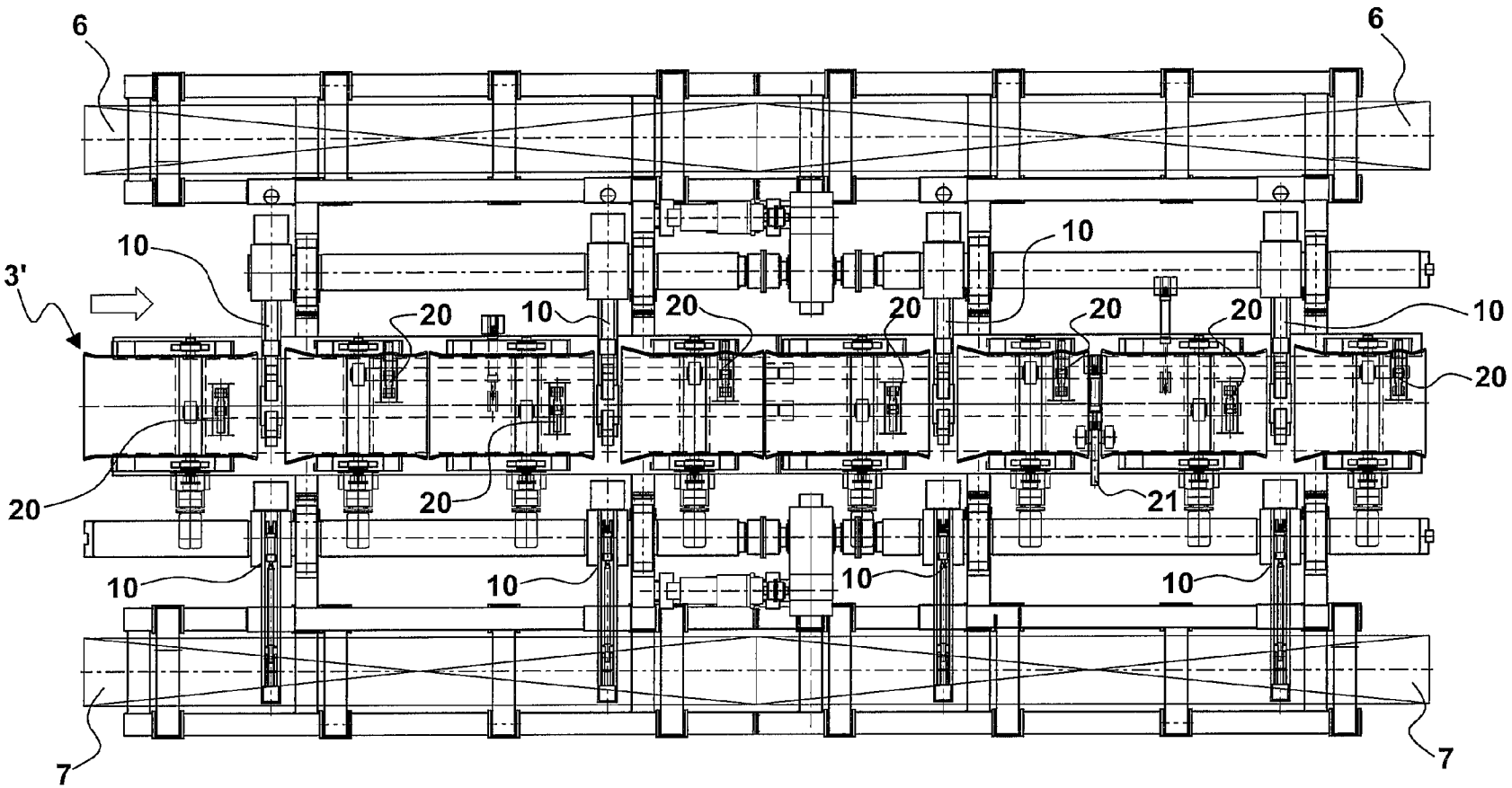
FIG. 5 is a top view of the module in FIG. 4.

FIG. 5 is a top view of a first module of the handling machine of the invention at the zone in which the two cooling tanks 6 and 7 are present. The other modules present in this zone are arranged side-by-side in sequence to reach a longitudinal extension at least equal to the length of the rails to be handled and treated.

A plurality of tilting means 20 is also provided along said second portion of the roller table 3' for tilting the rail 9 from an inclined position on one side with the head facing the cooling tank 6, with which position the rail reaching the second portion of the roller table 3', to a position with the head facing upwards with the flange completely resting on the roller table 3'.

Two series of handlers 10 are included: a first series arranged between the roller table 3' and the second cooling tank 6 for clamping a rail and rotating it so as to immerse it in said tank 6; a second series arranged between the roller table 3' and the third cooling tank 7 to clamp a rail and rotate it so as to immerse it in said tank 7. The handlers 10 of the two series are advantageously aligned to one another along the extension of the plant: this configuration results in a reduction of the openings along the sides of the roller table 3' with a consequent lower risk of sticking of the rail.

Two series of transmission shafts 11 are thus provided, each series arranged at an intermediate position between the tank 6 and the roller table 3' and between the tank 7 and the same roller table 3', respectively.

Figure 4:
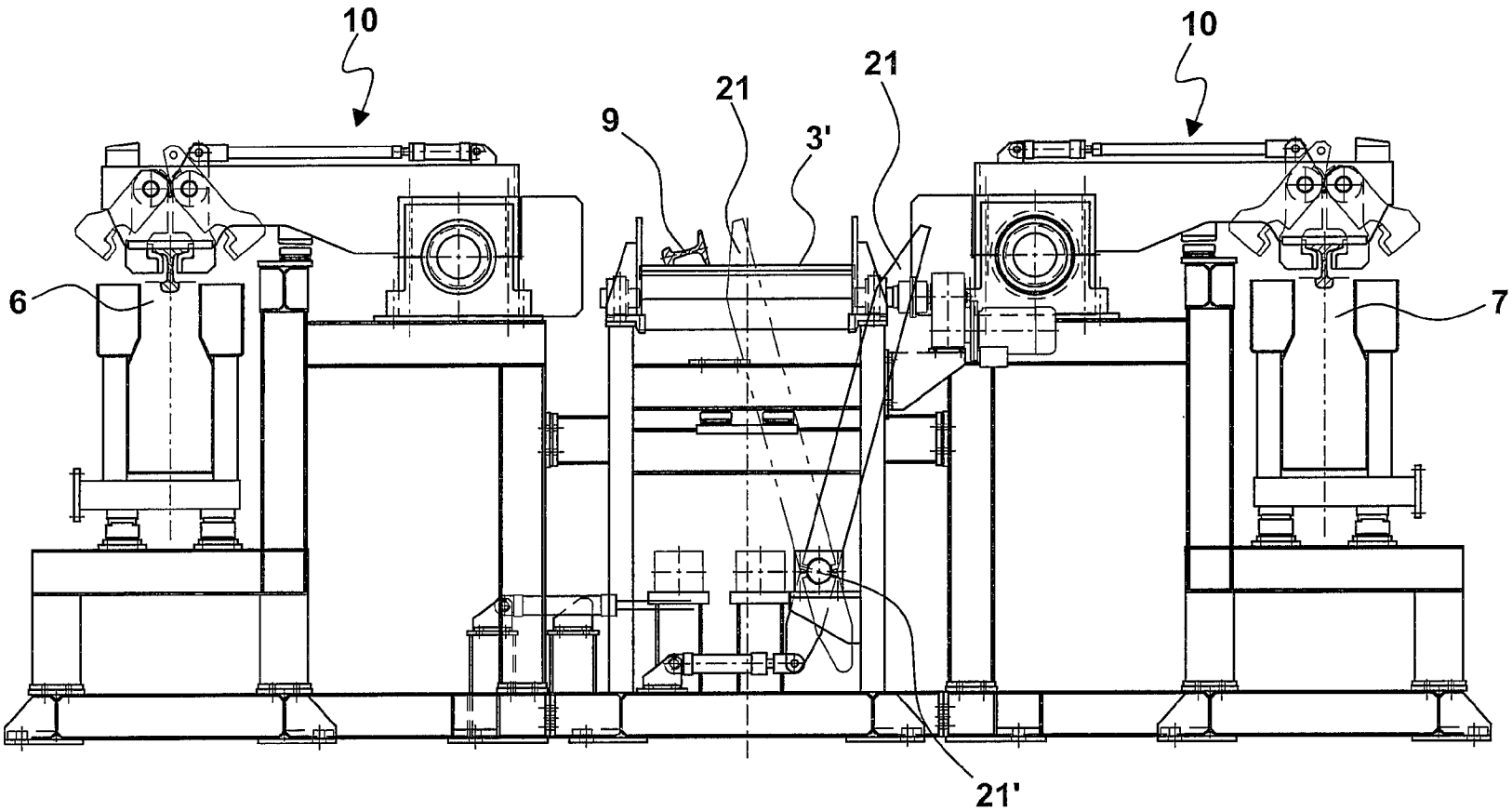
FIG. 4 is a side view of a further module of a handling machine for handling rails according to the invention.

A pusher 21 (FIGS. 4 and 5) is advantageously provided along the second portion of the roller table 3'; said pusher by rotating about a pivoting pin 21' thereof by a predetermined angle, e.g. 30°, may return the rail 9, inclined on one side, to the side part of the roller table 3' proximal to the second tank 6, if undesired movements of the rail occurred when feeding from the first to the second portion.

If the first cooling tank 5 is empty, after transferring a rail 9 to the first roller table 3', by means of the first transfer trolley 4, the handling process of the invention comprises the following steps:

- the rail 9 is tilted onto the first portion of the roller table 3' with the head facing upwards and resting on the flange only, as described above for steps 2) and 3);
- steps from 4) to 16) are carried out in the zone of the plant comprising the cooling tank 5 and the corresponding first portion of the roller table 3';
- feeding the rail 9 along the second portion of the roller table 3', next to which the second 6 and third 7 cooling tanks are arranged, without interfering with the handlers and the tilting means provided along said second portion of the roller table 3';
- unloading the rail 9 with the thermally treated head onto the second transfer trolley 4' which returns it to the second roller table 3 which in turn unloads it onto the cooling plate 8.

If the first cooling tank 5 is occupied by a previous rail, instead, the rail 9 is transferred to the second portion of the roller table 3' and:

- if the second cooling tank 6 is free, the rail is tilted, clamped and the head is thermally treated in said second tank 6 as described in steps from 2) to 16);
- if the second cooling tank 6 is occupied, the rail is tilted, clamped and the head is thermally treated in the third cooling tank 7 as described in steps from 2) to 16).

The main advantage achieved by this second embodiment of the handling machine is represented by a production rate of 27 rails/hour and an hourly production rate of 180 tons/hour.

The thermal treatment cycle which is carried out in the quenching area, i.e. in the zone comprising the roller table 3' and the cooling tanks, last for about 130 seconds/rail. The whole process cycle, from unloading onto the roller table 3 at the outlet of the last rolling mill stand to unloading again onto the same roller table 3 after completing the thermal treatment, lasts for 270 seconds.

The invention claimed is:

1. Handling machine for handling a rail, provided with a head and a flange, the machine comprising:

a plurality of tilting means for tilting the rail from a first position inclined on a side thereof to a second position wherein the rail head is turned upwards;

a plurality of handlers provided with clamping means adapted to clamp the rail at the flange, wherein each of said clamping means are provided with two jaws, pivotable around respective pivoting pins and configured so that the rail clamping occurs by contacting portions of internal surface of the jaws only with the sides of the flange of the rail, wherein each of said tilting means comprises leverages adapted to actuate a respective first plate and a respective second plate, each pair of first and second plates being hinged to a same pin, characterised in that the handlers are adapted to move the rail from said second position wherein the rail head is turned upwards to a third position wherein the rail head is turned downwards, and the first and second plates of each pair are configured so as to tilt the rail from the first position inclined on a side thereof, where said first and second plates of each pair are aligned so as to define a L-shaped cross section as a whole, to the second position wherein the rail head is turned upwards, where said first and second plates of each pair define a C-shaped cross section as a whole, and wherein the second plates in said second position are adapted to cooperate with the handlers whereby, before the clamping of the rail, a straightening of the rail occurs by rotating the handlers starting from a resting position thereof in order to raise up the rail to reach a contacting position between the rail head and the second plates.

2. Machine according to claim 1, wherein each of the handlers comprises an arm integrally fixed at a first end thereof onto a transmission shaft.

3. Machine according to claim 2, wherein the jaws of said clamping means are provided at a second end of the arm.

4. Machine according to claim 3, wherein actuating means for actuating the jaws are provided on each arm.

5. Thermal treatment plant for rails for subjecting a head of said rails to a in-line thermal treatment, the rails exiting from a rolling plant defining a rolling axis, said thermal treatment plant comprising:

a first longitudinal roller table, placed parallel to the rolling axis;

a first longitudinal cooling tank, placed adjacent and parallel to said first roller table; and a handling machine according to claim 1, wherein first tilting means are placed along the first roller table for tilting the rails from a first position inclined on a side thereof on said first roller table to a second position wherein the head of the first rail is turned upwards on the same first roller table;

and a first series of handlers, provided with clamping means adapted to clamp a first rail at the flange, which is able to move said first rail from said second position on the first roller table to a third position above the first cooling tank with the head turned downwards.

6. Plant according to claim 5, wherein there is provided a second longitudinal roller table placed along the rolling axis to receive the rails exiting from said rolling plant, and the first longitudinal roller table is placed at a predetermined distance from the rolling axis, in said predetermined distance there being provided a first transfer device to transfer the rails exiting from the rolling plant from the second roller table to the first roller table.

7. Plant according to claim 6, wherein the first longitudinal cooling tank is adjacent to a first portion of the first roller table for thermally treating the head of a first rail, and wherein there are provided:

a second longitudinal cooling tank, placed adjacent and parallel to a second portion of the first roller table, said second portion being downstream with respect to the first portion, for thermally treating the head of a second rail, and a third longitudinal cooling tank, placed adjacent and parallel to said second portion on the opposite side with respect to the one of the second tank, for thermally treating the head of a third rail.

8. Plant according to claim 7, wherein the first series of handlers is placed between said first cooling tank and said first portion of the first roller table and there are provided:

a second series of handlers, placed between said second cooling tank and said second portion of the first roller table, for handling the second rail and subjecting it to the thermal treatment in the second tank, and a third series of handlers, placed between said third cooling tank and said second portion of the first roller table, for handling the third rail and subjecting it to the thermal treatment in the third tank.

9. Plant according to claim 8, wherein the handlers of the second series and of the third series are aligned to each other along the extension of said second portion of the first roller table.

10. Plant according to claim 9, wherein a second transfer device is provided to transfer the rails, the head thereof has been thermally treated, from the first roller table to the second roller table.

11. Plant according to claim 7, wherein along the second portion of the first roller table there is provided a pusher pivoting around a pivoting pin thereof to adjust in said second portion the position of the rails inclined on a side thereof.

12. Handling process for handling a rail, by means of a handling machine according to claim 1, comprising the following steps:

tilting the rail, by means of a plurality of tilting means, from a first position inclined on a side to a second position wherein the rail head is turned upwards;

clamping the rail, by means of clamping means of a plurality of handlers, by contacting portions of internal surface of the jaws only with the sides of the flange of the rail;

rotating the handlers to move the rail from said second position wherein the head is turned upwards to a third position wherein the head is turned downwards, wherein in the step of tilting the rail there is provided actuating each pair of first and second plates by the respective leverages for tilting the rail from a first position inclined on a side thereof, where said first and second plates of each pair are aligned so as to define a L-shaped cross section as a whole, to a second position wherein the rail head is turned upwards, where said first and second plates of each pair define a C-shaped cross section as a whole, and wherein there is provided, before the step of clamping the rail, a straightening of the rail by rotating the handlers, starting from a resting position thereof, in order to raise up the rail to reach a contacting position between the rail head and the second plates in said second position.

13. Process according to claim 12, wherein in the step of straightening the rail is raised by means of a supporting surface.

* * * * *